US005668518A

United States Patent [19]

Carner

[11] Patent Number: 5,668,518

[45] Date of Patent: Sep. 16, 1997

[54] WIRE WOUND DRUM

[75] Inventor: Marshall A. Carner, Fairview, Pa.

[73] Assignee: Eriez Manufacturing Company, Erie, Pa.

[21] Appl. No.: 755,829

[22] Filed: Nov. 26, 1996

[51] Int. Cl.[6] ..... H01F 5/02; B03C 1/00

[52] U.S. Cl. ..... 335/296; 335/299; 336/177; 336/223; 210/222; 209/219

[58] Field of Search ..... 335/296–299; 210/222, 223; 209/218–224; 336/177, 223

[56] References Cited

U.S. PATENT DOCUMENTS 781,077 1/1905 Langguth ..... 209/219

3,024,910 3/1962 Palasvirta et al. ..... 209/219

3,233,587 2/1966 Morton ..... 209/219

*Primary Examiner*—Cassandra C. Spyrou

*Assistant Examiner*—Raymond M. Barrera

*Attorney, Agent, or Firm*—Lovercheck and Lovercheck

[57] ABSTRACT

A wire wound drum using a magnetic element having a non-magnetic shell and a matrix material bonded to the shell and made up of a non-magnetic wire and a magnetic wire wound on the shell in bobbin fashion single layer alternate magnetic and non-magnetic wires having the outer diameter of the wire machined down to the center line of the wire wrap to produce a flat surface.

3 Claims, 1 Drawing Sheet

WIRE WOUND DRUM

BACKGROUND OF THE INVENTION

A magnetic circuit has been developed that produces extremely high tractive forces by combining a magnetic source field with a wire wound matrix. The design described herein incorporates a permanent magnet source field. The magnetic circuit is designed to produce a deep field for particle traction as well as a strong field around the wire wound matrix for maximum magnetic induction of the wires. The induced magnetic wires capture the particles and separate them from the product flow.

The wire wound matrix is composed of two wires, one magnetic and one non-magnetic, wound in a bobbin fashion, as a single layer onto the outer surface of a non-magnetic shell. The winding being such that the wires form a matrix that alternates from magnetic wire to non-magnetic wire across the width of the shell. These wires are fixed in place by a suitable bonding material as they are wrapped onto the shell. The outer diameter of the shell with the wire matrix, is then machined down to the wire wrap centerline to produce a flat surface.

The magnetic circuit is a radial interpole design using high energy NdFeB magnets. Alternate circuits may be employed depending on the desired performance. The magnetic circuit induces the magnetic wires producing an extremely high field strength and field gradient at, and near the wire surfaces that is capable of capturing weakly magnetic particles. The magnet element covers a fixed arc which allows the induced wires to leave the field as the shell rotates facilitating the removal of the particles.

SUMMARY OF THE INVENTION

It is an object of the present invention to provide a wirewound magnetic drum that has extremely high field strength and field gradient that is capable of affecting weakly magnetic particles.

Another object of the present invention to provide a wire wound drum that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 2:
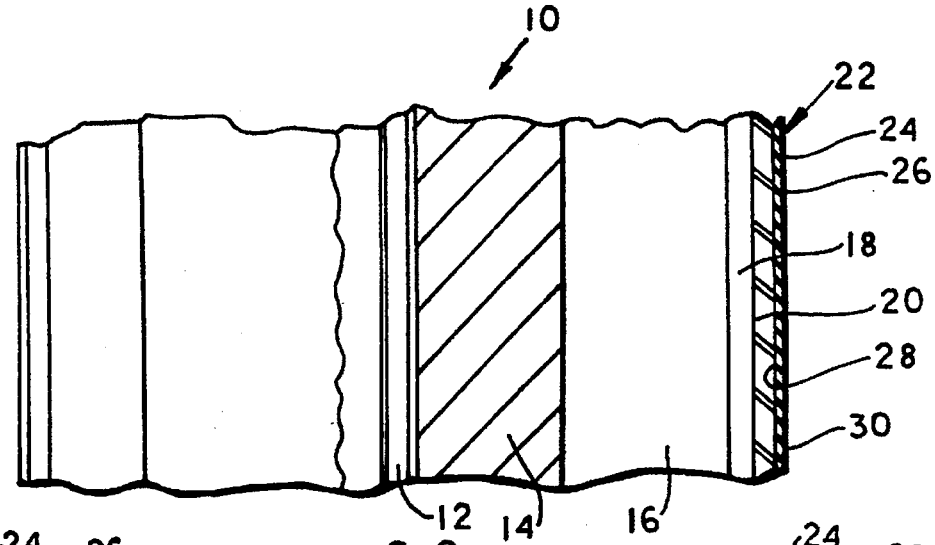
FIG. 2 is a cross sectional view taken on line 2—2 of FIG. 1 of the drum.
Figure 3:
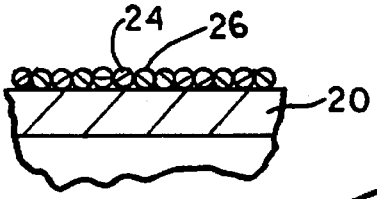
FIG. 3 is an enlarged partial cross sectional view of the magnetic wire and non-magnetic wire wound in bobbin fashion as a single layer.
Figure 4:
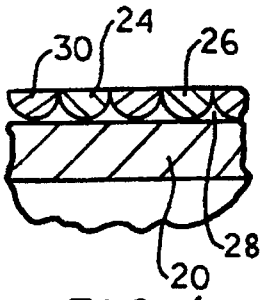
FIG. 4 is a further enlarged partial cross sectional view of the wires after machining.
Figure 1:
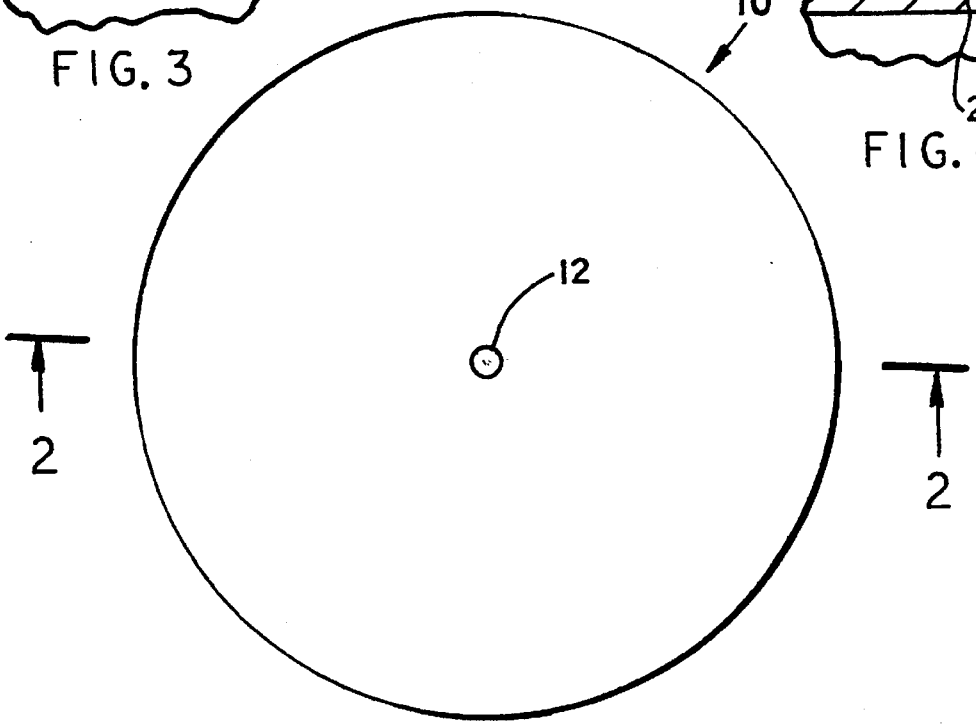
FIG. 1 is an end view of a wire wound drum according to the invention.

Now with more particular reference to the drawings, drum 10 is supported on shaft 12 and has yoke 14 supported in a suitable magnetic separator arrangement familiar to those skilled in the art. Magnetic element 16 is supported on yoke

14 and non-magnetic shell 20 is supported in spaced relation to magnetic element 16 and adapted to have a suitable drive means connected to shaft 12 to rotate drum 10.

Wirewound matrix 22 is made up of magnetic wire 24 and non-magnetic wire 26 wound in bobbin fashion as a single layer onto the outer surface of non-magnetic shell 20. The winding being such that magnetic wire 24 and non-magnetic wire 26 form a matrix that alternates from magnetic wire 24 to non-magnetic wire 26 across the width of non-magnetic shell 20. Magnetic wire 24 and non-magnetic wire 26 are fixed in place by a suitable bonding material 28 as they are wrapped onto non-magnetic shell 20. The outer diameter of non-magnetic wire 24 and magnetic wire 26 are then machined down to the wire wrap center line to produce flat surface 30. The magnetic circuit is a radial interpole design of a type familiar to those skilled in the art using high energy NdFeB magnets. Alternate circuits may be employed depending on the desired performance. The magnetic circuit induces magnetic wire 24 producing an extremely high field strength and field gradient at and near the wire surface that is capable of capturing weakly magnetic particles. Magnet element 16 covers a fixed arc which allows the induced wire to leave the field as the shell rotates facilitating the removal of the particles. Yoke 14, magnetic element 16 and non-magnetic shell 20 may be incorporated in a familiar magnetic separator type design.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A magnetic drum for use on a magnetic separator comprising;

a shaft;

a yoke supported on said shaft;

a magnetic element supported on said yoke;

a shell made of non-magnetic material supported in spaced relation to said magnetic element;

a matrix attached to said shell;

said matrix comprising a magnetic wire and a non-magnetic wire;

said wires being wound on the outer surface of said shell in bobbin fashion as a single layer;

said winding having said magnetic wire and said non-magnetic wire alternate across the width of said shell;

said wires being fixed to said shell by a bonding material as they are wrapped on said shell;

said outer diameter of said wires being machined down to the center line of said wires thereby producing a flat surface.

2. The magnetic drum recited in claim 1 wherein said magnetic element comprises a magnetic circuit having a radial design using high energy NdFeB magnets whereby said magnetic circuit induces said magnetic wire producing an extremely high field strength and field gradient at and near the wire surface that is capable of capturing weakly magnetic particles.

3. The magnetic drum recited in claim 2 wherein a drive means is provided to rotate said shell relative to said magnetic element whereby said magnetic circuit induces said magnetic wire providing an extremely high field strength and field gradient at and near the wire surface that is capable of capturing weakly magnetic particles.

* * * * *